US005625375A

United States Patent [19]

Keen

[11] Patent Number: 5,625,375

[45] Date of Patent: Apr. 29, 1997

[54] METHOD AND APPARATUS FOR A MULTIPLE FONT DISPLAY

[75] Inventor: Donald M. Keen, Indianapolis, Ind.

[73] Assignee: Lucent Technologies Inc., Murray Hill, N.J.

[21] Appl. No.: 369,556

[22] Filed: Jan. 6, 1995

Related U.S. Application Data

[63] Continuation of Ser. No. 163,453, Dec. 7, 1993, abandoned.

[51] Int. Cl.[6] ..... G09G 5/26

[52] U.S. Cl. ..... 345/128; 345/141

[58] Field of Search ..... 345/127, 128, 345/129, 141–143, 144, 195, 25

[56] References Cited

U.S. PATENT DOCUMENTS

| | | | |
|---|---|---|---|
| 3,868,673 | 2/1975 | Mau | 345/145 |
| 3,895,375 | 7/1975 | Williams | 345/141 |
| 4,146,877 | 3/1979 | Zimmer . | |
| 4,323,892 | 4/1982 | Kinghorn | 345/141 |
| 4,504,829 | 3/1985 | Usui | 345/141 |
| 4,661,808 | 4/1987 | Rector | 345/143 |
| 4,713,657 | 12/1987 | Tischer | 345/26 |
| 4,716,405 | 12/1987 | Yamaguchi | 345/141 |
| 5,301,027 | 4/1994 | Kiyofuji et al. | 345/124 |

FOREIGN PATENT DOCUMENTS

| | | | |
|---|---|---|---|
| 4-52691 | 6/1990 | Japan | 345/143 |
| 2029055 | 3/1980 | United Kingdom . | |
| 1585071 | 2/1981 | United Kingdom . | |
| 2090451 | 7/1982 | United Kingdom . | |
| 2091467 | 7/1982 | United Kingdom . | |
| 2164189 | 12/1986 | United Kingdom | 345/903 |

OTHER PUBLICATIONS

Tandy, "TRS-80 Color Computer Technical Reference Manual" Ft. Worth 1981. pp. 22.27.

IBM Tech Disc Bull, 26(4):2120 Sep. '83.

*Primary Examiner*—Richard Hjerpe
*Assistant Examiner*—Amare Mengistu

[57] ABSTRACT

A method and apparatus for displaying more than one font on a limited dot matrix display device are disclosed. In addition to displaying characters in a standard font based on using all pixels in a five by seven pixel matrix, a custom font set based on a reduced size pixel matrix is used for character display. A maximum of four columns and six rows of pixels, i.e., a four by six matrix, are used for the custom font out of the five columns and seven rows of pixels which are available. In further embodiments of the invention, the pixels which are not used to create a character may be used to add a background characteristic. Thus a reverse video font or underlining font may be created. In an additional embodiment, a box can be placed around a word by using the underline font in conjunction with placing a vertical line immediately before the first character and immediately after the last character of a word to be placed in a box.

11 Claims, 4 Drawing Sheets

METHOD AND APPARATUS FOR A MULTIPLE FONT DISPLAY

This is a continuation of application Ser. No. 08/163,453 filed on Dec. 7, 1993, now abandoned.

FIELD OF THE INVENTION

This invention relates generally to multiple font displays and specifically to dot matrix multiple font display devices.

BACKGROUND OF THE INVENTION

Small, monochrome dot matrix displays are used in a variety of consumer products such as VCRs, telephones, electronic musical instruments, microwave ovens and security control panels. Such displays usually have about two to four lines of text with sixteen to twenty characters per line. The displays typically utilize LCD technology.

These dot matrix displays may typically use a five column wide by seven row high matrix to form each character. Each character is normally defined to use all available pixels. Thus, each character is seven pixels high by five pixels wide. Characters are normally designed into the LCD panel hardware or are produced subject to software control of the pixel drivers.

It is essential that users be able to quickly recognize and differentiate types of information presented on such displays. In particular, labels for buttons or softkeys, adjacent to the display should be visually distinct from instructions or status information presented in the display. Since small dot matrix displays are typically monochrome, colors cannot be used for such a purpose. Further, since all available pixels are used to form each character, underlining may not be used for emphasis, such as is done on a CRT monitor.

One approach for providing emphasis to screen information has been to incorporate predefined words, known as annunciators, in the display. Fixed annunciators are provided in certain areas of the display aside from the usual program or hardware driven text characters defined by the pixel matrix. To provide emphasis, the characters of the annunciator are typically of a different size than the text characters defined by the pixel matrix. Typically, annunciators are turned "on" when their use is available, at which time they are visible on the display. Alternatively, annunciators are turned "of" and are substantially "invisible" when their use is unavailable. Each annunciator must be placed on the display in a unique position, i.e., no annunciator can overlap another annunciator. Due to the small size of the LCD panel, the number of annunciators which may be used is restricted. Further, such annunciators are fixed and must be embedded during the manufacturing process. If the manufacturer later decides that the annunciators are not correct, are confusing or otherwise wishes to change the annunciators, new display panels must be manufactured to embed the new words.

Another way to highlight information on limited dot matrix displays is to "blink" the character, i.e., turn the character's pixels on and off. The blinking character technique is often used in the following manner. In many cases, the limited dot matrix displays, in conjunction with the hardware they are associated with, offer options on the display to help the user accomplish certain tasks. These options are typically accessed by pressing two or more hardware buttons or softkeys, one a cursor key to move through the options and another an enter key to select the option. When moving through possible choices, usually the left-most word is highlighted first. Each time the cursor key is pressed, the next word to the right is highlighted. When the option highlighted is the one the user wishes to select, the user presses the enter key. Highlighting is accomplished by "blinking" the characters. Product research has shown that users are frequently confused by this type of display because it is often difficult to ascertain what option is actually being selected.

Accordingly, there is a need for a means to more clearly highlight and display information presented on limited pixel displays.

SUMMARY OF THE INVENTION

In accordance with the invention, a multiplicity of visually distinctive or custom font sets have been developed which are readily distinguishable from the standard display font.

All of the custom font sets are based on using a reduced size pixel matrix to represent the characters. A maximum of four columns and six rows, i.e., a four by six matrix, are used to display a custom font character. Thus, one row and one column of the five by seven pixel matrix which is used to display the standard font is not used. Additional custom fonts utilize pixels in the one column and one row which are not used to create a character to add a background characteristic such as reverse video, underlining or boxing. The custom fonts replace extended ASCII characters.

DETAILED DESCRIPTION

Figure 1:
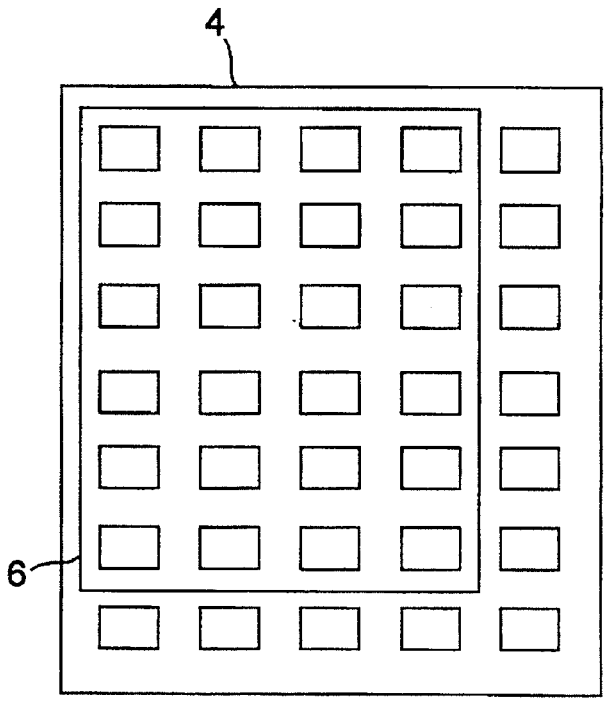
FIG. 1 is an illustration of a five by seven matrix used to display a standard font and a four by six matrix used to display a font according to the present invention.

The present invention comprises a method and apparatus for providing a custom font which is based on a reduced size pixel matrix. As illustrated in FIG. 1, rather than using the full extent of the five by seven matrix 4 to display characters as with a standard font display, the custom font utilizes a maximum of four out of the five columns of pixels to define the lateral extent or width of a character and six out of the seven rows of pixels to define the vertical extent or height of a character, i.e., a four by six matrix 6. The character of a custom font should differ in size from the standard font by at least twenty percent to be clearly distinguishable from the standard font. Four by six matrices other than matrix 4 can be defined in the standard five by seven matrix. For example, a matrix comprising the four right-most columns and six upper-most rows will define a second four by six matrix. It should be understood that four by six matrices other than that defined in FIG. 1 are suitable for producing the custom fonts of the present invention.

In addition to the distinctiveness achieved by the reduction in character size, the unused pixels may be used to add background visual characteristics as discussed below.

Figure 2:
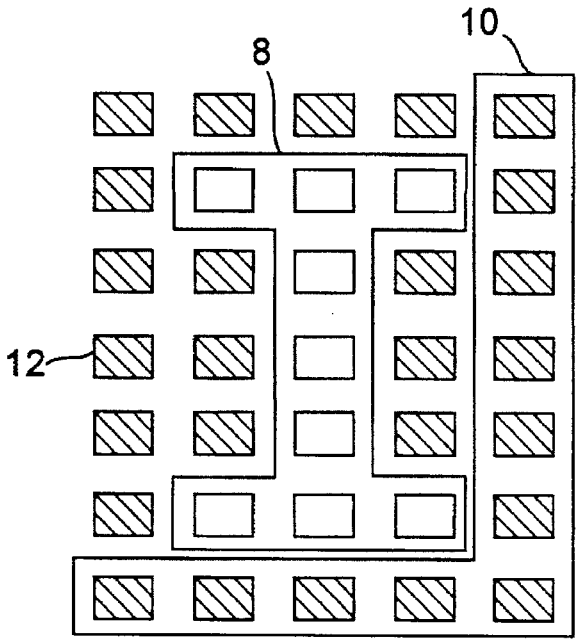
FIG. 2 is an illustration of a reverse video font according to the present invention.

A second custom font may be a reverse video font, as shown in FIG. 2. For this font, pixels, such as pixel 12, that are not used to represent a character, for example the letter "T" in FIG. 2, are activated, whereas pixels 8 normally used to represent the character are not activated. The pixels activated for the reverse video font include pixels 10 from the at least one row and one column of pixels which are not used to create custom font characters, as well as the pixel 12 and all other pixels of the four by six matrix other than the pixels 8. In addition to the distinctiveness of the reverse video format, the character itself is smaller than the standard font since it is defined by a four by six matrix.

Figure 3:
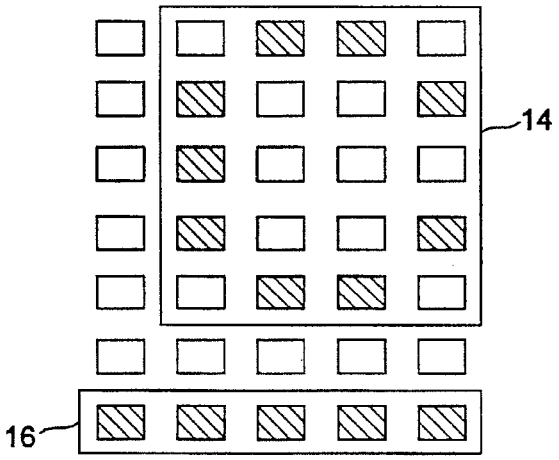
FIG. 3 is an illustration of an underline font according to the present invention.

A third custom font is illustrated in FIG. 3. This font is again smaller than the standard font, and comprises defining the character, such as a "C" in FIG. 3, in the upper five rows 14 of the matrix. The pixels of the sixth row are not activated, but the pixels of the seventh row 16 are activated, thus creating an underline font.

Figure 4:
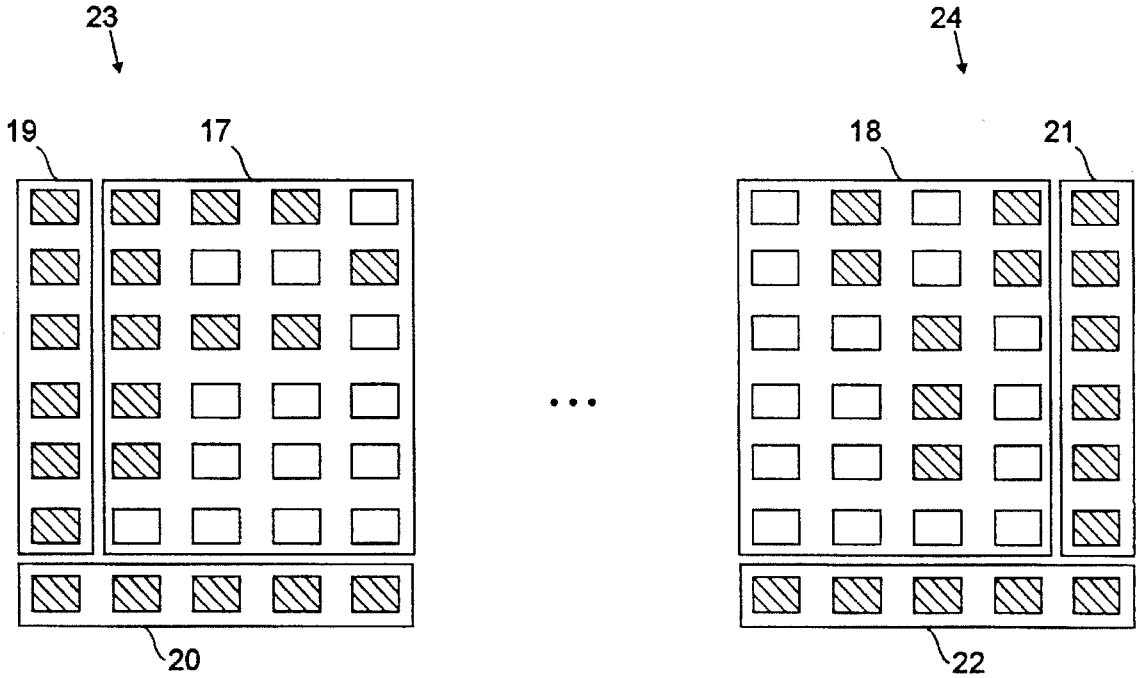
FIG. 4 is an illustration of how a box may be placed around a word in conjunction with a font according to the present invention.

In a fourth custom font, which is illustrated in FIG. 4, a "box" may be drawn around a word. Due to size limitations, only three sides of the box can be created. The box is created by using the underline font to display characters in conjunction with creating a first vertical line in front of the first character of a word to be boxed and a second vertical line after the last character of the word.

Specifically, software controls the character display so that the first character is displayed in a four by six pixel matrix 17 which occupies the right-most four columns and upper-most six rows of a five by seven pixel matrix 23. A vertical line, representing the left side of the box, is defined by activating the upper six pixels 19 of the first column of the five by seven pixel matrix. The portion of the line defining the bottom of the box directly beneath the first or any character within the box is created using an underline font as described above. Thus, in FIG. 4, the first character to be boxed, a "P," appears in the underline font discussed in connection with FIG. 3. All five pixels 20 of the bottom row of the five by seven pixel matrix 23 are activated to create the portion of the box beneath the character "P."

The last character of the word to be boxed, a "Y" in FIG. 4, is followed by a vertical line representing the right side of the box. Software controls the character display so that the last character is displayed in a four by six pixel matrix 18 which occupies the left-most four columns and upper-most six rows of a five by seven pixel matrix 24. A vertical line, representing the right side of the box, is defined by activating the upper six pixels 21 of the last column of the five by seven pixel matrix 24. Characters, not shown, falling between the first and last character of the boxed word, are displayed using the underline font so that the bottom of the "box" is defined.

Alternatively, a box could be created by placing a line over, rather than under, the characters. However, the above described method of placing the line below the characters is preferred.

The custom fonts may be used to great advantage if "menu" driven features are available to the user. When selecting various options presented on the display, the selection may be written in the custom font, rather than "blinking" the characters to display the selected option as in the prior limited pixel displays. As the cursor or movement key is pressed, the option written in the custom font would be rewritten in the standard font, and the next word, now positioned for selection, would be rewritten in the custom font.

Figure 5:
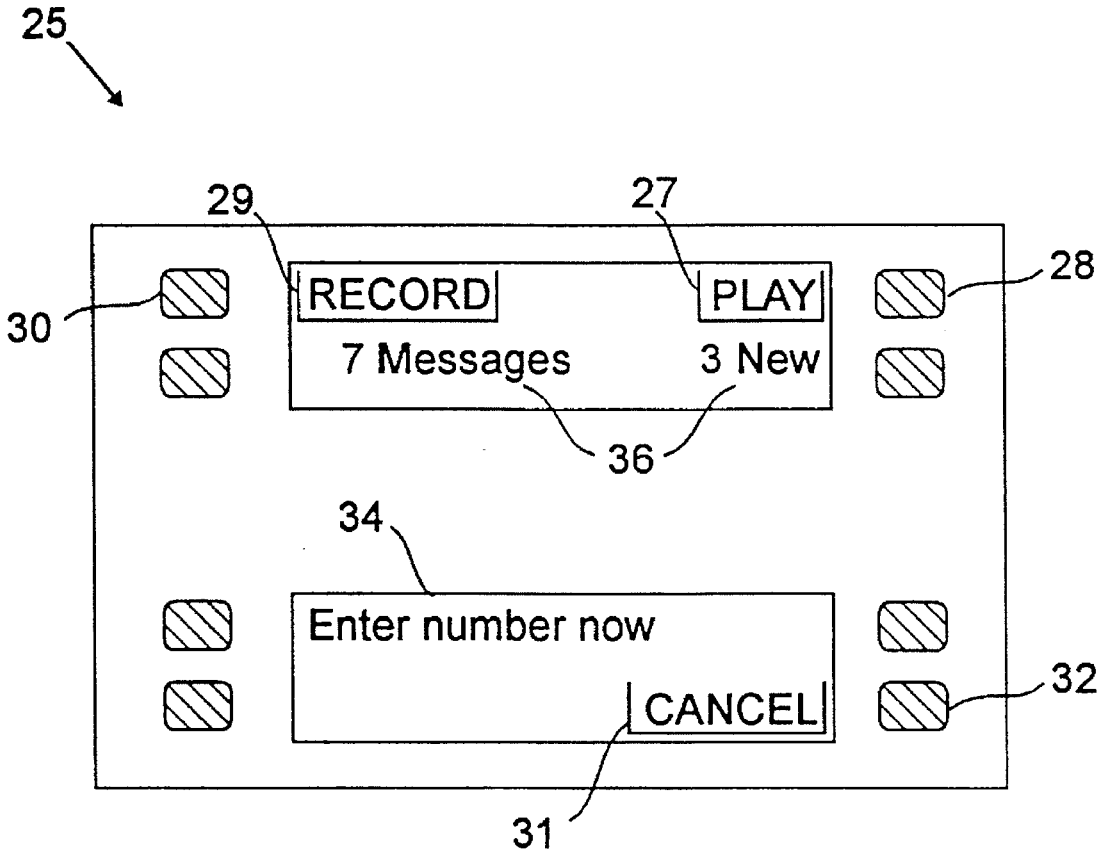
FIG. 5 is an illustration of using boxing according to the present invention to set off a label from other information appearing in a dot matrix display.

Further, as illustrated in FIG. 5, the custom font may be used by a manufacturer to create its own special selection keys, known as soft-keys. When annunciators are used for this purpose, only a limited number of options may be offered, since each annunciator occupies a unique physical space in the display. Using the custom font, a virtually unlimited number of options are available, since any word may be formed. FIG. 5 shows a display 25 having softkeys 28, 30 and 32, labels 27, 29 and 31 which describe the function of the softkeys, and instructional 34 or status 36 information. The custom font insures that the labels, such as the labels 27, 29, 31 for the associated adjacent soft-keys 28, 30, 32 of the display 25 are visually distinct from instructions 34 or status information 36 presented in the display.

Figure 6:
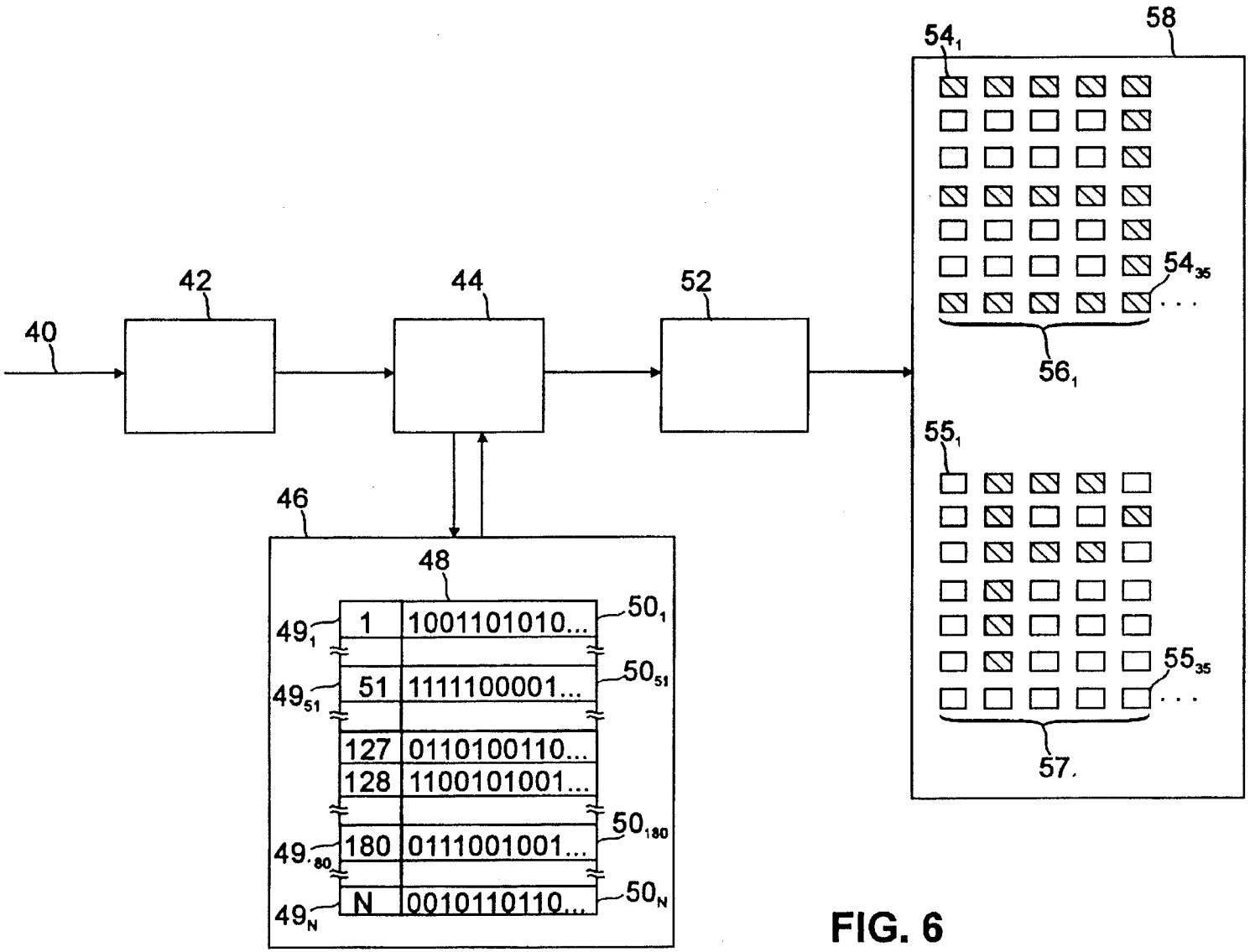
FIG. 6 is a schematic diagram of a processing arrangement to implement a font according to the present invention.

The custom fonts may be implemented by hardware or software methods well known to those skilled in the art, including, but not limited to, the following method. In a presently preferred embodiment, the custom font or fonts would replace some or all of the extended ASCII characters, which are typically foreign and graphic characters. Extended ASCII characters range from 128 to 255 decimal, or 80 to FF hex. At a minimum, the custom font would replace hex AO to DF, or decimal 160 to 223. The custom font is "written" to the display screen by processing the ASCII code through the use of a processing arrangement such as is illustrated in FIG. 6. The ASCII code 40 for the custom font characters that are selected to appear in the display is transmitted to a buffer 42, and then to a processing unit 44. Stored within memory 46 is a look-up table 48 which contains bit maps $\mathbf{50}_{1-N}$ for each of the number, N, of characters of both the standard and the custom font, which characters are identified by their ASCII codes $\mathbf{49}_{1-N}$. Standard font characters may be represented by ASCII codes 32 to 127 decimal, while the custom font characters may be represented by ASCII codes 128 to 255 decimal. ASCII codes 1–31 decimal are typically reserved for control characters. The bit map is a series of ones and zeros which is a positional representation of the pixels $\mathbf{54}_{1-35}$ and $\mathbf{55}_{1-35}$ of the display matrices $\mathbf{56}_1$ and $\mathbf{57}_1$, respectively. The bit map indicates which pixels of a given matrix should be activated, and which pixels should not be activated to display a given character. While only two display matrices $\mathbf{56}_1$ and $\mathbf{57}_1$ are shown, it should be understood that the display 58 will typically comprise a plurality of display matrices. Display matrix $\mathbf{56}_1$ may be considered the first matrix of approximately sixteen to twenty of such matrices associated with a first line of text display, and display matrix $\mathbf{57}_1$ may be considered the first matrix of approximately sixteen to twenty of such matrices associated with a second line of text display.

The processing unit 44 retrieves data from the appropriate bit map $\mathbf{50}_{1-N}$, which data is then transmitted to a display driver 52. The display driver 52, which is well known to those skilled in the art, may be implemented in various ways. Fundamentally, it converts the numbers of the bit map to signals representing row and column coordinates of the various pixels $\mathbf{54}_{1-35}$ and $\mathbf{55}_{1-35}$ of the display matrices $\mathbf{56}_1$ and $\mathbf{57}_1$, respectively. The signals from the display driver 52 are transmitted to the display matrices $\mathbf{56}_1$ and $\mathbf{57}_1$, which signals activate or "turn on" the appropriate pixels to display a given character.

To illustrate the display of two fonts, FIG. 6 shows a standard font "3" appearing in display matrix $\mathbf{56}_1$ and a custom font "P" appearing in display matrix $\mathbf{57}_1$ of display 58. It should be understood that a standard or a custom font character may appear in any of the display matrices. In the present illustration, the ASCII code 51 decimal at code line $\mathbf{49}_{51}$ corresponds to a standard font "3" and the ASCII code 180 decimal at code line $\mathbf{49}_{180}$ corresponds to a custom font "P". To display a standard font "3" as the first character of the first line of text in the display 58, the processor 44 retrieves the data contained in bit map $\mathbf{50}_{51}$, which corresponds to the ASCII code 51 decimal, and transmits the data to the display driver 52. Hardware and software associated with the display driver convert the data from the bit map $\mathbf{50}_{51}$ to signals representing pixel location, and activate the appropriate pixels of the display matrix $\mathbf{56}_1$. As a result, "3" appears in the display. Similarly, the data from bit mat $\mathbf{50}_{180}$, which corresponds to the ASCII code 180 decimal, is retrieved by the processor 44 and transmitted to the display driver 52. The display driver converts the bit map information and displays the custom font "P" in the pixel matrix $\mathbf{57}_1$.

It should be understood that the embodiments and variations shown and described herein are illustrative of the principles of this invention and that various modifications may occur to, and be implemented by, those skilled in the art without departing from the scope and spirit of the invention.

I claim:

1. A method for creating a character in a first visually distinctive font for display on a limited size dot matrix display device, the limited size dot matrix display device comprising a plurality of independent five column by seven row pixel matrices in which the pixels have an activated state and an inactivated state, where a character of a standard font is created using the full extent of one of the plurality of independent five column by seven row pixel matrices and a character of the first visually distinctive font is created using a maximum of four columns of pixels to define the width of the character and a maximum of six rows of pixels to define the height of the character, and wherein pixels not defining the character of the first visually distinctive font are used to create a background characteristic, and wherein a one-to-one correspondence exists between the number of independent five column by seven row pixel matrices and a maximum number of characters that can be displayed in either the standard font or the first visually distinctive font, comprising the steps of:

defining the character by identifying which pixels of the four columns and six rows of pixels should be activated to display the character;

defining a background characteristic by identifying which of the pixels that are not used to define the character should be activated and activating the pixels to display the character and the background characteristic.

2. The method of claim 1 where the step of defining the character further comprises the step of reading data from a look-up table, which data is contained in a bit map stored within the look-up table, where the data is indicative of which pixels in the pixel matrix should be activated to display the character and which pixels of the at least one row of pixels and one column of pixels which are not used to define the character should be activated to display the background characteristic.

3. The method of claim 2 where defining the character further comprises the step of converting the data from the look-up table to a signal representing the row and column coordinates of the pixels to be activated to display the character and the background character.

4. The method of claim 1 where the background characteristic is chosen from the group consisting of underlining boxing and reverse video.

5. A limited size dot matrix display device capable of displaying a first and second font comprising:

a display having a plurality of independent five column by seven row pixel matrices for character display, each matrix consisting of pixels having an activated state and an inactivated state;

a data source having data which defines a character of the first font by using all pixels of one of the plurality of independent five column by seven row pixel matrices and which defines a character of the second font by using a maximum of four columns and six rows of pixels of one of the plurality of independent five column by seven row pixel matrices to define the width and the height of the character, respectively, the data source having character definitions for any character of the first and second font which is to be displayed, the data source further having defining a character of the second font to include a background characteristic;

a means for converting the data defining a character to be displayed to a signal representing the row and column coordinates of the pixels to be activated to form the character; and a means for activating the pixels of a pixel matrix according to the signal to display the character;

wherein a one-to-one correspondence exists between the number of independent five column by seven row pixel matrices and a maximum number of characters that can be displayed in either the first or second font.

6. The limited size dot matrix display device of claim 5 where the data defining the background characteristic comprises defining a line under a character using the at least one row of pixels which are not used to define the character.

7. The limited size dot matrix display device of claim 5 where the data defining the background characteristic comprises defining a partial box around at least two characters using the at least one row and one column of pixels which are not used to define the characters.

8. The limited size dot matrix display device of claim 5 where the data defining the background characteristic comprises defining a reverse video font wherein the pixels surrounding the character are activated and the pixels of the character itself are not activated.

9. The limited size dot matrix display device of claim 5 where the display is a liquid crystal display.

10. The limited size dot matrix display device of claim 5 where the data source is a look-up table.

11. The limited size dot matrix display device of claim 10, where the look-up table further comprises a bit map, where data stored in the bit map is indicative of which pixels in the pixel matrix should be activated to form the character in the display.

* * * * *